US007794257B2

(12) United States Patent
Rozet et al.

(10) Patent No.: US 7,794,257 B2
(45) Date of Patent: Sep. 14, 2010

(54) HERMAPHRODITIC ELECTRICAL CONTACT

(75) Inventors: Dominique Rozet, Rambouillet (FR); Claude Casses, Clevilliers (FR); Gerard Mulot, Nogent le Roi (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/311,172

(22) PCT Filed: Sep. 24, 2007

(86) PCT No.: PCT/EP2007/008280

§ 371 (c)(1),
(2), (4) Date: Apr. 13, 2009

(87) PCT Pub. No.: WO2008/034639

PCT Pub. Date: Mar. 27, 2008

(65) Prior Publication Data

US 2009/0311898 A1 Dec. 17, 2009

(30) Foreign Application Priority Data

Sep. 22, 2006 (WO) ..... PCT/FR2006/050928

(51) Int. Cl.
*H01R 13/28* (2006.01)

(52) U.S. Cl. ..... 439/290

(58) Field of Classification Search ..... 439/291, 439/290, 752, 832
See application file for complete search history.

(56) References Cited

U.S. PATENT DOCUMENTS

| | | | | |
|---|---|---|---|---|
| 2,335,843 | A | 11/1943 | Rogoff | 287/103 |
| 2,406,895 | A | 9/1946 | Olson | 287/76 |
| 2,744,244 | A | 5/1956 | Schumacher et al. | 339/258 |
| 3,202,954 | A * | 8/1965 | Kinkaid | 439/290 |
| 4,061,406 | A * | 12/1977 | Kunkle | 439/291 |
| 4,192,566 | A | 3/1980 | Laudig et al. | 339/47 R |
| 4,373,262 | A | 2/1983 | Blakesley | 29/882 |
| 5,108,304 | A | 4/1992 | Bogiel et al. | 439/290 |
| 6,030,244 | A * | 2/2000 | Buckheit et al. | 439/291 |
| 2002/0049005 | A1 | 4/2002 | Leve | 439/825 |

FOREIGN PATENT DOCUMENTS

| | | |
|---|---|---|
| DE | 1 164 532 B | 3/1964 |
| GB | 968 814 A | 9/1964 |
| GB | 2 243 498 A | 10/1991 |

* cited by examiner

*Primary Examiner*—Phuong K Dinh
(74) *Attorney, Agent, or Firm*—Harrington & Smith

(57) ABSTRACT

Electrical contact having a longitudinal axis along which a first central body and at least one first blade are produced, characterized in that this electrical contact is intended to be mated with a complementary electrical contact which itself has a second central body and at least one second blade, extending generally in the longitudinal direction of the second contact, so that when the contact and the complementary contact are mated the first blade is in electrical contact with the second central body and the second blade is in electrical contact with the first central body.

23 Claims, 8 Drawing Sheets

Figure 1:
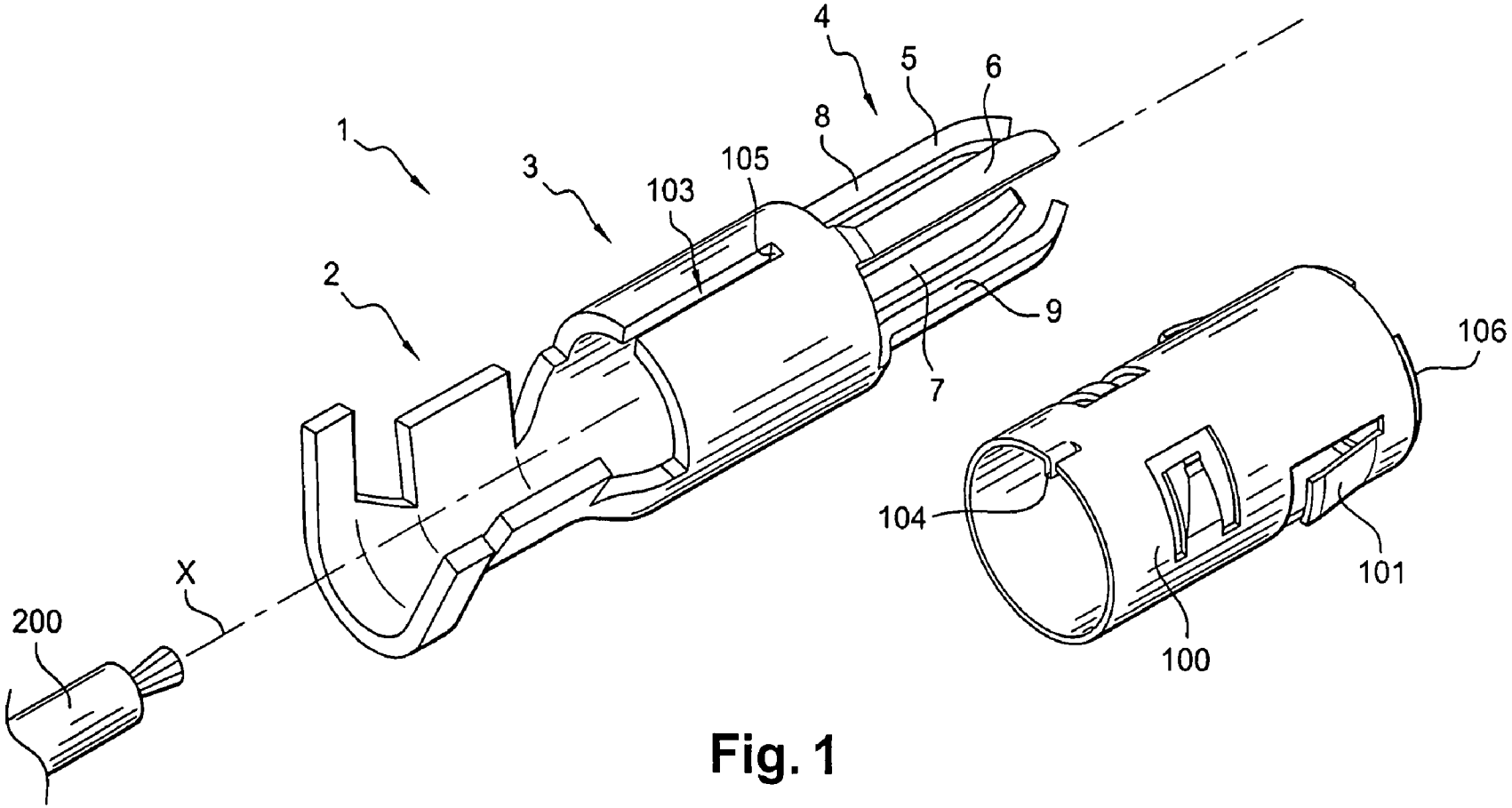

Fig. 7
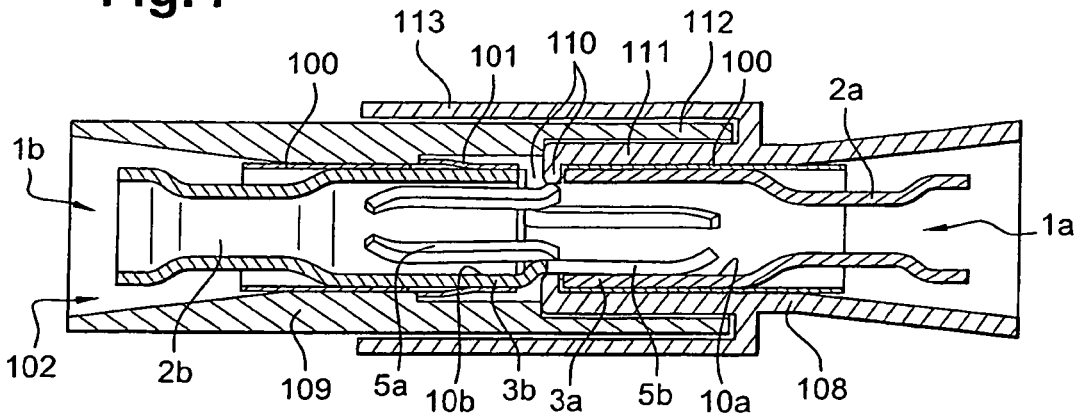
Fig. 8A
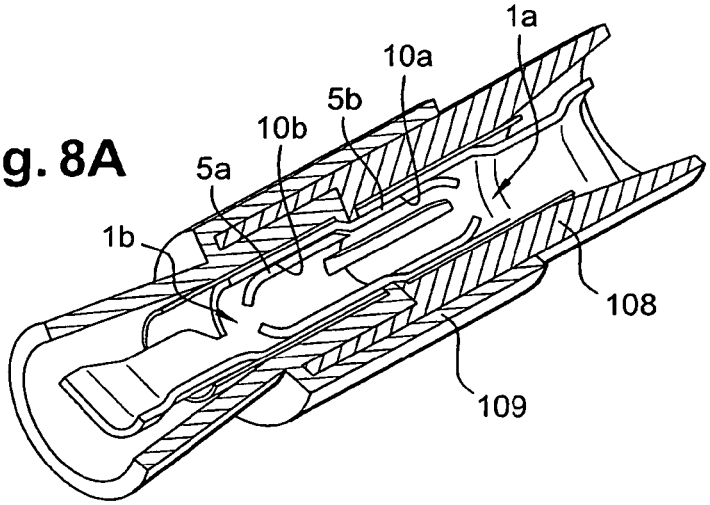
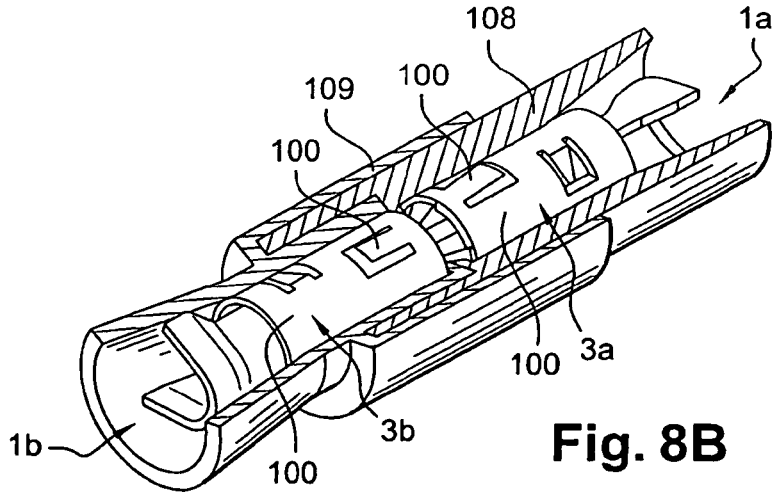
Fig. 8B

HERMAPHRODITIC ELECTRICAL CONTACT

The present invention concerns an electrical connection device provided with a pair of contact elements comprising a first contact element and a second contact element complementary to the first.

According to a first aspect of the invention, the first and the second contact elements are contact elements, each of which is provided with a multi-blade contact end so as to create hermaphroditic contact elements.

A hermaphroditic contact is a contact having a front contact part that can be interlaced with a second contact of a form identical to the first.

Document US 2002/0049005 A1 describes a contact element having a contact end provided with a plurality of metal contact blades arranged in a corolla and given an outer camber suitable for creating an electrical contact with a complementary metal tubular contact element.

The contact blades operate with radial elasticity with regard to the longitudinal axis of the contact.

However, this document does not describe a pair of contact elements wherein each is provided with a multi-blade contact end so as to create hermaphroditic contact elements.

The interest in creating contacts provided with hermaphroditic ends resides in the simplification of connection systems for which only a single type of contact would be made, and therefore only a single tooling would be necessary, and the logistics management and assembly of the connectors would be simplified.

Moreover, the optimization of the current capacity of the contact elements provided with hermaphroditic ends would be easier, since each contact element of a pair of hermaphroditic contact elements has the same contact electrical resistance behavior and therefore has the same temperature when intense current is transmitted.

As a result, the dimensional calculations and the choice of the blank thickness for creating contacts are simplified.

For this purpose, according to a first aspect, the invention proposes an electrical contact according to claim 1.

For example, the blades bear an upper face and a lower face, and electrical contact zones are made between at least a part of the upper faces of the blades and the internal face of a central body of said complementary contact.

Alternatively or complementarily, since the blades have an upper face and a lower face, electrical contact zones are made between at least a part of the lower faces of the blades and the outer face of a central body of said complementary contact.

The invention also concerns an electrical contact comprising at least one of the characteristics defined by claims 2 to 9, taken in combination or alone, an electrical contact comprising at least one of the characteristics defined by claims 10 to 16, taken in combination or alone, a connector comprising at least one of the characteristics defined by claim 17 and also an electrical contact according to claim 18.

Also, according to a second aspect of the invention, a device can be provided for protecting the electrical contact blades, this device comprising a sliding element attached with the electrical contact and designed to protect the contact blades by covering them when the contact is not inserted in a reception socket of the electrical contact, in order to prevent any risk of twisting or breaking the blades.

According to a particular embodiment, the attached cage element has means for engaging the contact in a reception socket for the contact in a connector housing receiving at least said contact.

Advantageously, the contact is received in an insulating housing and the insulating housing has means for pressing the cage into a rear position when the contact is inserted into the housing.

Thus, between the manufacture of the contact and its insertion into the insulating housing, the contact blades are protected by the cage element which extends beyond the front of the central body into an advanced position, and when the contact is inserted into its socket in the insulating housing, the cage element is pressed into the rear position freeing the contact blades.

Figures 2A, 2B, 2C:
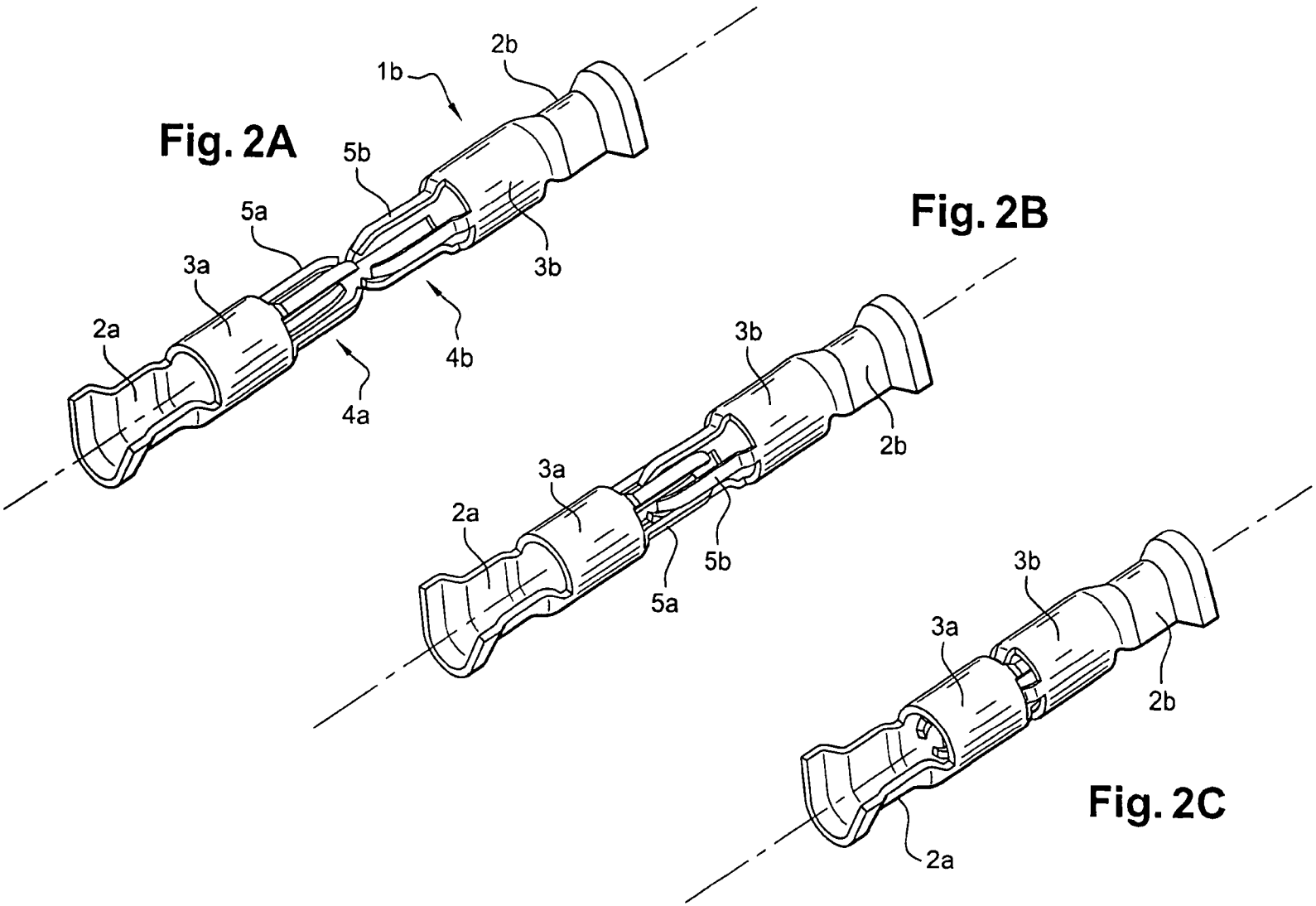
Figure 3:
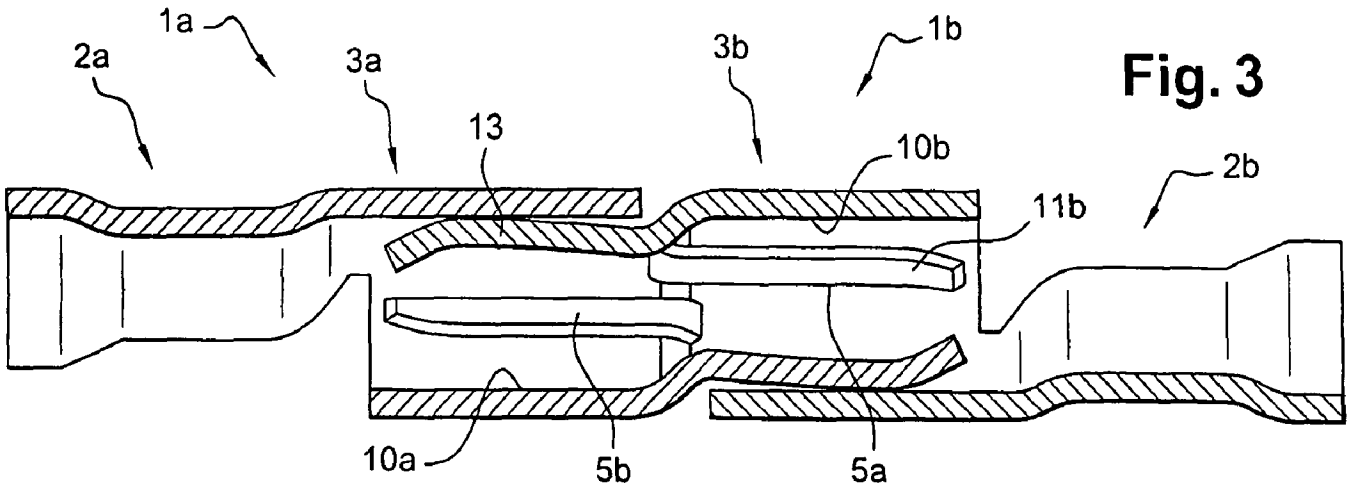
Figure 4:
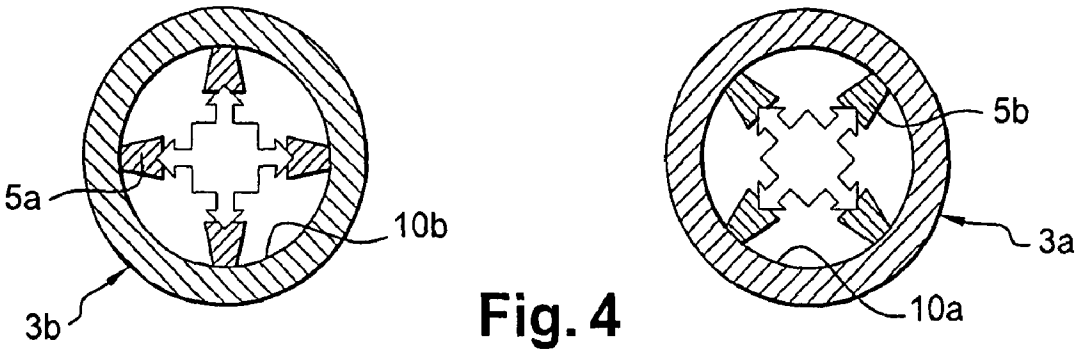
Figure 5A:
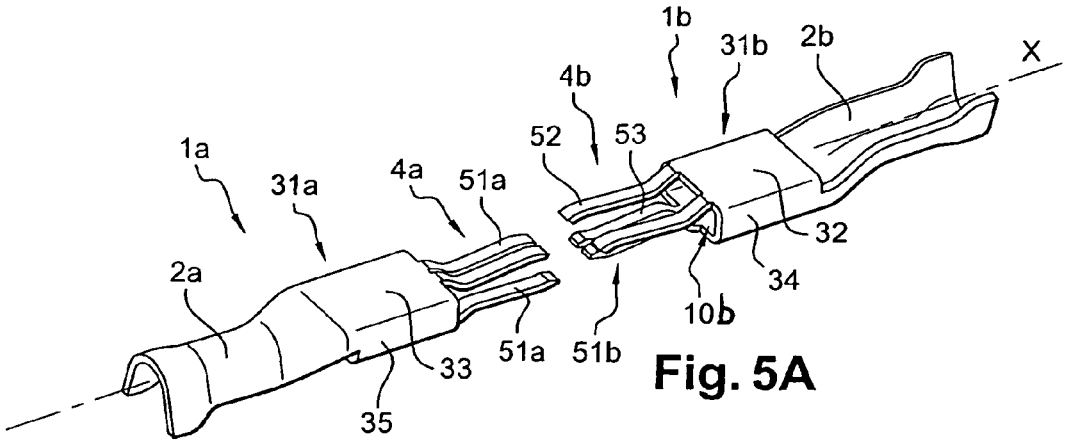
Figure 5B:
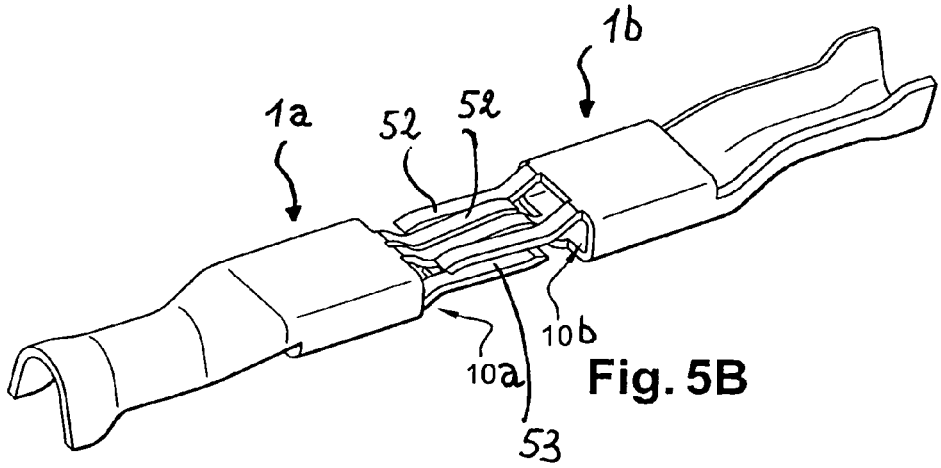
Figure 5C:
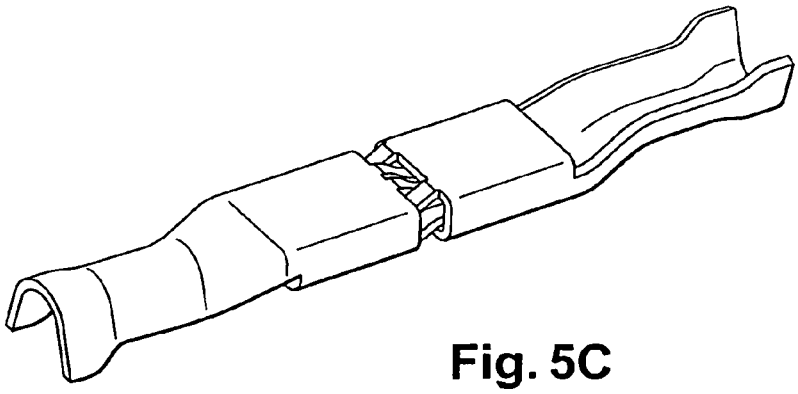
Figure 5D:
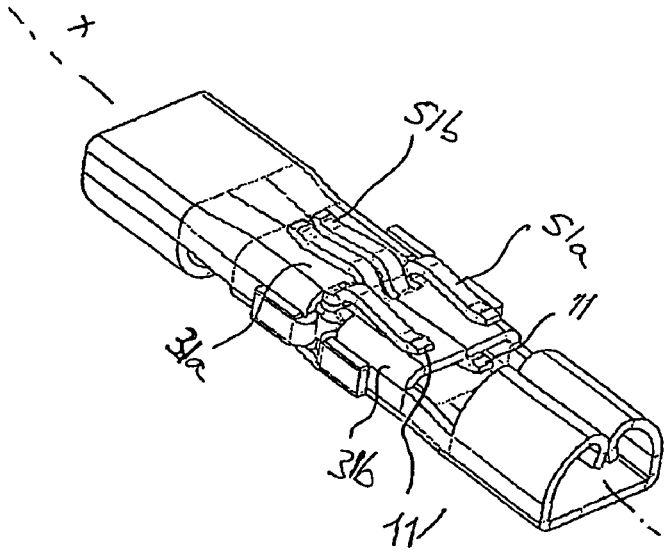
Figure 5E:
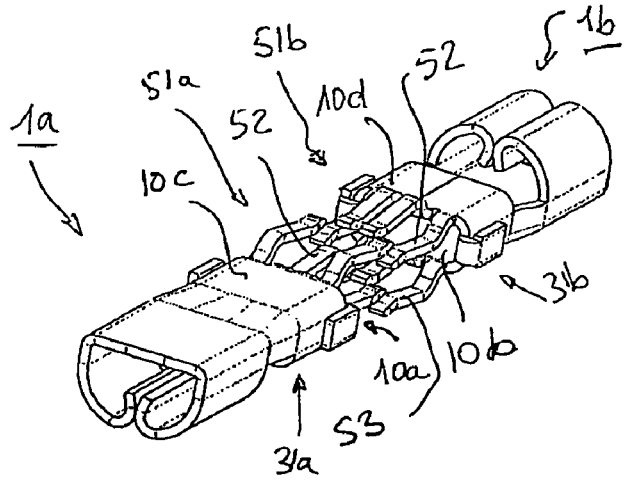
Figure 6A:
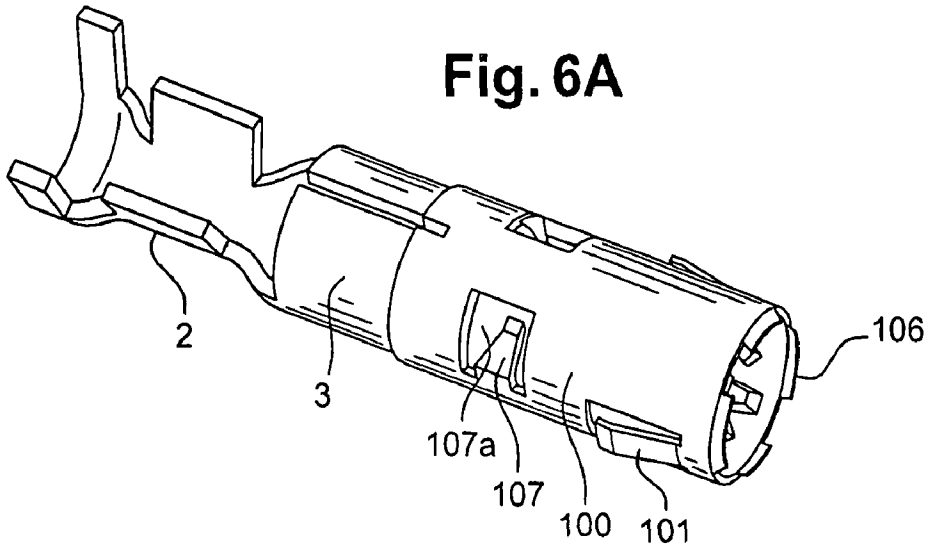
Figure 6B:
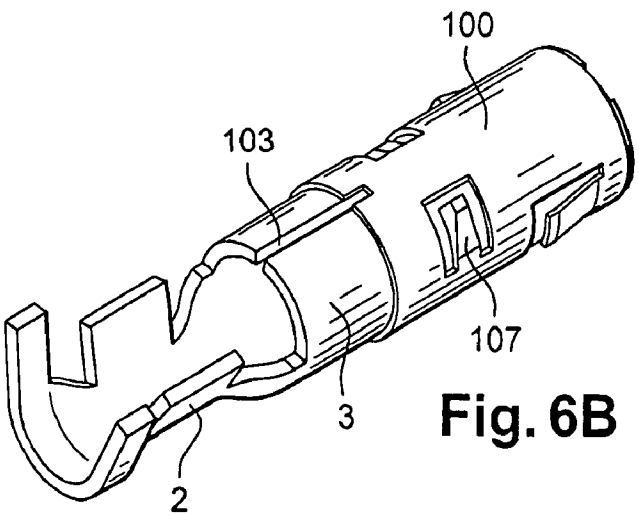
Figure 6C:
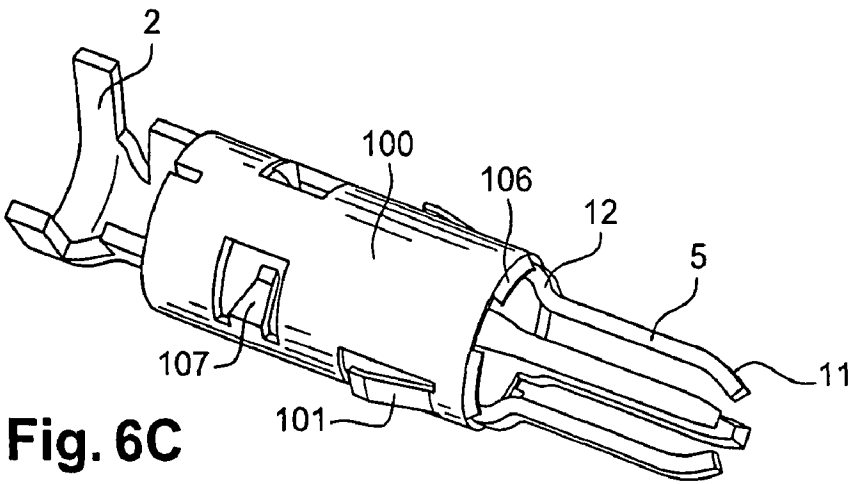
Figure 10B:
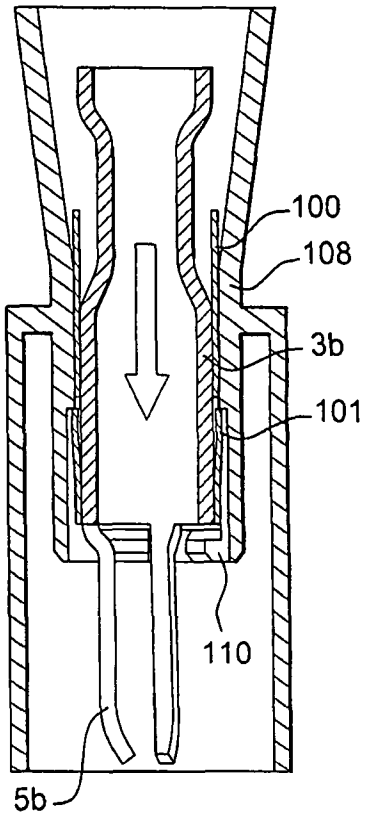
Figure 10A:
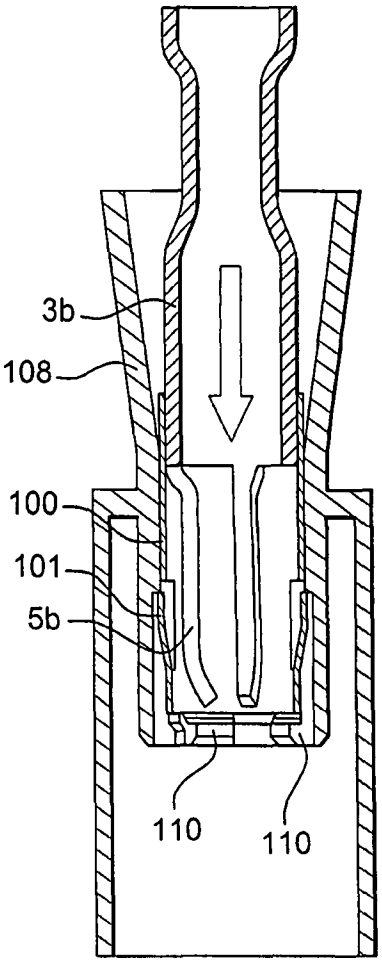
Figure 9A:
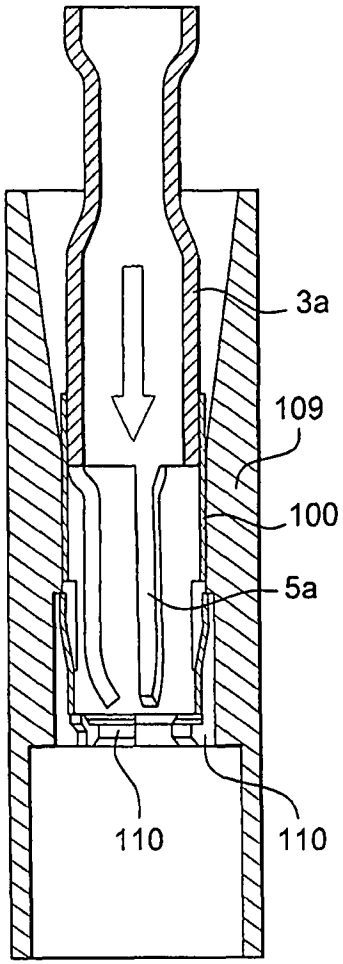
Figure 9B:
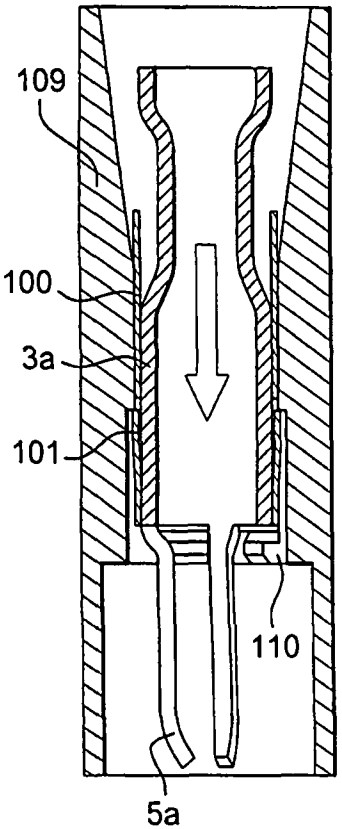

Other aspects and advantages of the invention will become apparant upon reading the description that follows of non-limiting examples of embodiment of the invention in reference to the drawings, which show:

in FIG. 1: a perspective three-quarter rear view of a first example of embodiment of a contact according to the invention;

in FIGS. 2A, 2B, 2C: perspective views of a pair of contacts, according to a second example of embodiment of the invention, in the process of being mated, in FIG. 3: a longitudinal-sectional view of the contacts of FIG. 2A when mated;

in FIG. 4: a cross-sectional view of the contacts of FIG. 3;

in FIGS. 5A, 5B, 5C, 5D, 5E: perspective views of a pair of contacts, according to a third and a fourth example of embodiment of the invention, in the process of mating, in FIGS. 6A, 6B, 6C: perspective views of the contact of FIG. 1 showing the positions of a cage element according to a second aspect of the invention;

in FIG. 7: a sectional view of a pair of connector housings receiving a pair of contacts according to the first aspect of the invention;

in FIGS. 8A, 8B: perspective sectional views of the housings of FIG. 7;

in FIGS. 9A, 9B: sectional views of the insertion of a contact according to the invention into a male housing;

in FIGS. 10A, 10B: sectional views of the insertion of a contact according to the invention into a female housing.

FIG. 1 shows an electrical contact 1 provided with a longitudinal axis (x) along which are successively created a connection end 2, a central body 3 and a contact end 4.

Connection end 2, according to the example, is a crimpable end designed to receive a cable 200.

It can be replaced by any type of known end for electrical contacts.

According to this first example of embodiment of the invention, the electrical contact is a tubular contact, with symmetry of revolution around axis x, made from a cut-out and coiled blank.

According to the invention, the contact end has a first plurality of blades 5 extending generally in the longitudinal direction of the electrical contact.

This plurality of blades 5 is distributed regularly along a curve defining a cylinder.

The blades have an upper face 6 facing the outside of the cylinder, a lower face 7 facing the inside of the cylinder, and lateral faces 8, 9 perpendicular to said upper faces and lower face.

The blades are made with a generally S-shaped profile along their longitudinal axis, having a free end 11 bent toward longitudinal axis x of the contact and an end 12 for connection to the central body stepped in, so as to reduce the envelope section of the blades relative to the section of the central body.

The central body is a tube with an inner section slightly smaller than the outer envelope surface of the blades.

According to this first example of embodiment, the central body receives an attached cage element 100, which will be described later.

The functioning of the contact is shown in FIGS. 2A to 2C, which represent a second type of contact according to the invention, contacts without attached cage elements.

According to the first aspect of the invention, contact 3 is a hermaphroditic contact which is mated with a complementary contact having a contact section itself bearing a plurality of blades 5*b* held between the blades of the first plurality of blades 5*a* of the first contact. Two contacts according to the invention 1*a* and 1*b* are shown before connection in FIG. 2A, in the process of connection in FIG. 2B and connected in FIG. 2C.

In order to create the electrical connection between two contacts of the invention, blades 5*a* of the first contact are held between complementary blades 5*b* of the second contact, complementary electrical contact 1*b*, said complementary blades forming a second plurality of blades 5*b* being held in the same way between the blades of the first plurality of blades 5*a*.

The two contacts are aligned on the same coupling axis head-to-head with a rotation of one of the two contacts on the coupling axis so that the blades of the first contact are positioned in the gaps or spaces between the blades of the second contact.

In order to be mated, the contacts are offset in rotation along axis x so that blades 5*a* of a first contact 1*a* are positioned between blades 5*b* of a second contact 1*b*.

When the contacts are joined together, the blades of the plurality of blades 5*a*, 5*b* enter into central bodies 3*b*, 3*a* and electrical contact zones are created between at least a part of upper faces 6 of the blades and an inner face 10*a*, 10*b* of central bodies 3*a*, 3*b* of complementary contacts 1*a*, 1*b*, as shown in FIG. 3.

Therefore, the blades are not in contact with the complementary contact blades, but rather in contact with the inner face of the central body of the complementary or conjugate contact.

In order to create the contact zones, the S-shaped blades have a segment 13 slightly inclined toward the outside between ends 11 and 12, the outer face of segment 13 coming to rub against the inner face of body 3.

The contact pressure permitting electrical connection is generated by the pressure of the central body on the blades, due to the fact that that the central body is a tube with an inner section slightly smaller than the outer envelope surface of the blades.

In order to obtain a contact pressure that is correct and stable over time, the metal of the contacts is advantageously a highly-elastic metal alloy such as a beryllium-copper alloy.

FIG. 4 diagrams the pressure forces of blades 5*a*, 5*b* for contact against inner surface 10*b*, 10*a* of central body 3*b*, 3*a* of the other contact and the relative angular positioning of the contact blades relative to the blades of the other contact.

Hermaphroditic contacts according to the invention are thus created so that said first and said second pluralities of blades 5, 5*a*, 5*b* constitute parallel electrical connections between central bodies 3, 3*a*, 3*b* of said electrical contact and complementary electrical contact 1, 1*a*, 1*b*.

Such a distribution permits reducing micro-disruption phenomena due to vibration.

Note that according to this example, the contacts each have four blades, but this number can be increased or decreased, for example, as a function of the contact diameter and the blade section.

FIGS. 5A to 5C represent a contact variant according to the invention for which central body 3 has a generally parallelepiped shape with an upper face 32, a lower face 33 and lateral flanks 34, 35.

According to this variant or third example of embodiment, blades 51*a*, 52*b* are distributed on the upper face and the lower face of the contacts and have an upper face 52 turned toward the outside of the contact, a lower face 53 turned toward the inside of the contact and flanks perpendicular to the upper face and the lower face of the contacts.

This example of embodiment is made from a cut-out and folded blank.

Like the cylindrical contact of the first and second examples of embodiment, the blades of blade pluralities 51*a*, 51*b* have an upper face 52 and a lower face 53 and electrical contact zones are created between at least one part of upper faces 52 of the blades and an inner face 10*a*, 10*b* of central body 31*a*, 31*b* of complementary contact 1*a*, 1*b*.

The first and second pluralities of blades 51*a*, 51*b* also constitute here parallel electrical connections between the central body 31*a*, 31*b* of said electrical contact and the complementary electrical contact 1*a*, 1*b*.

The blades of this second example of embodiment are made according to a generally S-shaped profile, bearing a free end 11 bent toward longitudinal axis x of the contact included in a longitudinal plane of symmetry of central body 31*a*, 31*b* of the contact and have an end 12 for connection with the central body stepped in, so as to reduce the section of the blade envelope relative to the section of the central body.

According to this example, two pairs of blades are respectively positioned at the end of upper face 32 and of lower face 33 of the central body of the contact, the blades of a first pair being side-by-side and the blades of a second pair being spaced apart.

Like the tubular contact, the parallelepiped contact of this example is a hermaphroditic contact for which the outer faces 52 of the blades come into contact with the inner face 10*a*, 10*b* of the central body.

FIGS. 5D and 5E correspond to a fourth example of embodiment for which, when compared with the third example, the contacts have blades contacting the outside of the central part, in addition to blades contacting the inside of the central part.

In this case, among the pluralities of blades 51*a*, 51*b* having an upper face 52 and a lower face 53, at least some of the blades constitute blades with inner contact by which electrical contact zones are created between at least a part of upper faces 52 of the blades and inner face 10, 10*a*, 10*b* of central body 31*a*, 31*b* of said complementary contact 1*a*, 1*b*, and at least some of the blades constitute outer contact blades by which electrical contact zones are created between at least a part of lower faces 53 of the blades and outer face 10*c*, 10*d* of central body 3*a*, 3*b* of said complementary contact 1*a*, 1*b*.

A first plurality of blades 51*a*, 51*b* of a first electrical contact 1*a* with a second plurality of blades 51*a*, 51*b* of a second complementary contact 1*b* constitute parallel electrical connections between central bodies 31*a*, 31*b* of electrical contacts 1*a*, 1*b*.

The blades contacting the inside and the outside of the central bodies are generally made in an S-shape.

The inner contact blades have a free end 11 bent toward the longitudinal axis of the contact and the external contact blades have a free end 11' bent in a direction away from longitudinal axis (x) of the contact.

According to this last example of embodiment, each contact 1*a*, 1*b* advantageously has 4 pairs of contacts, i.e., a pair of inner contact blades and a pair of outer contact blades on each of upper face 32 and of lower face 31, which creates 16 points of connection in all. Thus, the current capacity of the contact is increased. Furthermore, this permits the thickness of the sheet making up the faces of the central body being pressed between the inner contact blades and the outer contact blades, which makes the precision of the contact pressure principally dependent on the thickness of the sheet and relatively less dependent on the precision of manufacture of the central body.

FIG. 7 schematically shows an electrical connector provided with contacts according to FIG. 1.

The connector comprises a first housing 108 called a male housing in which a first contact 1*a* according to the invention is received, and a second housing, 109, a female housing receiving a second contact 1*b* according to the invention.

Each of housings 108, 109 has a skirt 111, 112, skirt 111 of the male housing being received inside skirt 112 of the female housing.

To increase the tightness of the connection, male housing 108 may have a second outer skirt 113 covering the mated part of the housings and creating with first skirt 111 of the male housing a "doughnut" around skirt 112 of the female housing.

FIGS. 8A and 8B respectively show housings equipped with a contact according to the second example of embodiment, a contact without an attached cage element, and a contact according to the first example, a contact with an attached cage element.

The usefulness of an attached cage element according to the second aspect of the invention will be discussed here within the scope of the drawings showing hermaphroditic contacts.

However, such an attached cage element is perfectly usable for terminal contacts or any electrical contact provided with a connection end, a central body, and at least one longitudinal contact blade.

According to this aspect of the invention, the contact has an attached cage element 100 more particularly shown in FIGS. 6A to 6C, designed to slide over central body 3 between a position protecting said at least one longitudinal blade and a rear position freeing said blade.

FIG. 6A, a three-quarter front perspective, and FIG. 6B, a three-quarter rear perspective, show the cage element in the advanced position for protecting the contact blades of contact 1, while FIG. 6C shows the cage in the rear position, freeing contact blades 5.

Attached cage element 100 has means 101 for engaging the contact in a reception socket 102 for said contact in a connector housing 108, 109 receiving at least said contact.

These engaging means here are inclined projections extending beyond the cage element toward the rear to form grapple pieces engaging on the shoulders of housings 108, 109 as shown in FIG. 7.

Advantageously, attached cage element 100 is kept from rotating, so as not to turn around the central body of the contact, and to do this, central body 3 and the cage element are provided with a longitudinal guiding device for the cage element comprising a groove 103 made in either cage element 100 or central body 3, and a stud 104 which slides in the groove and which is made in the other element, either cage element 100 or central body 3.

In order to limit the forward movement of cage element 100 along contact body 3 towards the contact blades, the groove has a first end with a front stop 105 for cage element 100.

Likewise, in order to prevent too much movement toward the rear and toward the connection end, attached cage element 100 has a front face 106 bent toward the inside and forming a rear stop for cage element 100.

In order to define a stable rear position, cage element 100 has a spur piece 107 locking the cage element onto the central body in the rear position.

This spur piece is made up of a tab arising from a cut-out in the cage element and folded toward the inside of the cage element.

This spur piece 107 also constitutes a spur piece for locking the cage element on the central body in the forward position and the cage element goes from one position to the other by elastic pressure on the spur piece, which is provided with a ramp 107*a* permitting it to be raised and mounted on the central body when the cage is pressed toward the rear into the position for releasing the contact blade or blades.

One example of an electrical connector receiving contacts provided with a cage element according to the invention is shown in FIGS. 9A, 9B and 10A, 10B.

FIGS. 9A, 9B show the introduction of a contact according to the invention into a female insulating housing 109 and FIGS. 10A and 10B show the introduction of a contact according to the invention into a male housing 108.

In order to hold back the cage element and permit blades 5*a*, 5*b* to move by into the connection position, insulating housing 108, 109 has means 110 for retaining the cage element by pressing it into the rear position when the contact is inserted into the housing.

These retaining means are shoulders regularly distributed over the periphery of the front of the socket part receiving the central body of the contacts and on which front 106 of the cage elements comes to rest.

These shoulders are also useful to angularly position the blades in the housing so as to correctly position the blades of the male housing relative to the blades of the female housing and to permit them to correctly interlace.

As previously indicated, the cage element according to the invention is applied to a hermaphroditic contact such as described above or to a traditional terminal contact.

The invention is not limited by the examples shown, and notably, cage element 100 can be created by a parallelepiped contact according to the third example of embodiment, since the number of hermaphroditic contact blades is not limited to 4 and the housings shown as single contact housings can be multi-contact housings provided with several sockets receiving hermaphroditic contacts such as described, as well as other contacts.

The invention claimed is:

1. An electrical contact provided with a longitudinal axis along which are successively located a first central body and at least one first blade extending in a general cantilevered fashion from a front end of the first central body characterized by the fact that this electrical contact is designed to be coupled to a complementary contact itself having a second central body and at least one second blade generally extending in the longitudinal direction of the second contact, so that when the contact and the complementary contact are mated, the first blade is in electrical contact with the second central body and the second blade is in electrical contact with the first central body, wherein the first blade comprises a section having a longitudinally curved cross-sectional shape in a location between an end of the first blade connected to the first central body and a free end of the first blade.

2. The electrical contact according to claim 1, having at least two first blades separated by spaces permitting the insertion of the second blade.

3. The electrical contact according to claim 2, in which blades are regularly distributed along the curve defining a cylinder and have an upper face turned toward the outside of the cylinder, a lower face turned toward the inside of the cylinder and lateral faces perpendicular to said upper face and said lower face.

4. The electrical contact according to claim 3, made from a cut-out and coiled blank.

5. The electrical contact according to claim 2, wherein the first central body has a generally parallelepiped shape having an upper face, a lower face and lateral flanks, the first blades being distributed over the upper face and the lower face and bearing an upper face facing the outside of the contact, a lower face facing the inside of the contact and flanks perpendicular to the upper face and the lower face of the contacts.

6. The electrical contact according to claim 2 for which at least some of the first blades have at least one part of upper faces of the blades designed to contact a portion of the inner face of second central body of complementary contact.

7. The electrical contact according to claim 2 for which at least some of the first blades have at least one part of lower faces designed to contact a portion of the outer face of second central body of complementary contact.

8. The electrical contact according to claim 1 for which at least one of the first blades has an end for connecting to the central body which is stepped in, so as to reduce the section of the envelope of the blades relative to the section of the central body.

9. An electrical contact as in claim 1 further comprising an attached cage element slid over central body between a protection position for said at least one first blade and a rear position for freeing said first blade.

10. The electrical contact according to claim 9 for which the attached cage element has means for engaging the contact in a reception socket for said contact in a connector housing receiving at least said contact.

11. The electrical contact according to claim 9 for which the attached cage element and first central body are provided with a longitudinal guiding device for the cage element having a groove made in either the cage element or the first central body, and a stud which slides in the groove and which is made in the other element, either the cage element or the first central body.

12. The electrical contact according to claim 11 for which the groove has a first end with a front stop for the cage element.

13. The electrical contact according to claim 9 for which the attached cage element has a front face bent toward the inside and forming a rear stop for the cage element.

14. The electrical contact according to claim 9 for which the cage element has a spur piece for locking the cage element on the first central body in the rear position.

15. The electrical contact according to claim 9 for which the cage element has a spur piece for locking the cage element on the central body in the advanced position.

16. An electrical connector having at least one contact according to claim 9 and an insulating housing characterized in that insulating housing has means for holding back the cage element by pressing it into the rear position when the contact is inserted into the housing.

17. An electrical contact according to claim 1, further characterized in that it has a cage element designed to slide over the first central body between a protection position for said at least one first blade and a rear position for freeing said first blade.

18. An electrical contact comprising:

a first central body; and at least one first blade directly connected to a front end of the first central body and extending in a general cantilevered fashion from the front end of the first central body, wherein the first blade has a stepped in section at an end of the first blade connected to the first central body, so as to reduce a section of an envelope of the first blade relative to a section of the first central body, wherein the electrical contact is sized and shaped to be coupled to a complementary contact having a second central'body and at least one second blade, so that when the electrical contact and the complementary contact are mated, the first blade is in electrical contact with the second central body and the second blade is in electrical contact with the first central body, and wherein the first blade is not in contact with the second blade.

19. An electrical contact as in claim 18 wherein the first blade comprises a general S-shaped profile along its longitudinal length, and wherein the first blade is inclined towards an outside direction between the stepped in section and a free end of the first blade.

20. The electrical contact according to claim 18, having at least two of the first blades separated by a space sized and shaped to permit insertion of the second blade between the at least two first blades.

21. The electrical contact according to claim 20, wherein the first central body has a generally parallelepiped shape having an upper face, a lower face and lateral flanks, the first blades being distributed over the upper face and the lower face and bearing an upper face facing the outside of the contact, a lower face facing the inside of the contact and flanks perpendicular to the upper face and the lower face of the contacts.

22. The electrical contact according to claim 20 for which at least some of the first blades have at least one part of upper faces of the blades designed to contact a portion of the inner face of second central body of complementary contact.

23. The electrical contact according to claim 20 for which at least some of the first blades have at least one part of lower faces designed to contact a portion of the outer face of second central body of complementary contact.

* * * * *